US007971548B2

(12) United States Patent
Kuenzel

(10) Patent No.: US 7,971,548 B2
(45) Date of Patent: Jul. 5, 2011

(54) SHALLOW WATER ANCHOR SYSTEM FOR FISHING BOATS

(75) Inventor: Rainer Kuenzel, Hunt, TX (US)

(73) Assignee: Stern Stick, LLC, Houston, TX (US)

( * ) Notice: Subject to any disclaimer, the term of this patent is extended or adjusted under 35 U.S.C. 154(b) by 10 days.

(21) Appl. No.: 12/354,819

(22) Filed: Jan. 16, 2009

(65) Prior Publication Data

US 2009/0223429 A1 Sep. 10, 2009

Related U.S. Application Data

(60) Provisional application No. 61/068,087, filed on Mar. 5, 2008.

(51) Int. Cl.
*B63B 21/24* (2006.01)

(52) U.S. Cl. ..... 114/294

(58) Field of Classification Search ..... 114/230.1, 114/294; 52/155; 37/346; 212/204, 256; 182/2.8

See application file for complete search history.

(56) References Cited

U.S. PATENT DOCUMENTS

| | | | | |
|---|---|---|---|---|
| 16,704 | A * | 2/1857 | Cumming | 440/5 |
| 3,731,943 | A * | 5/1973 | Wilkes | 280/613 |
| 4,073,078 | A * | 2/1978 | Leitz | 37/342 |
| 4,860,507 | A * | 8/1989 | Garza-Tamez | 52/167.4 |
| 5,460,246 | A * | 10/1995 | Burch et al. | 182/2.8 |
| 6,041,730 | A | 3/2000 | Oliverio et al. | |
| 2010/0012013 | A1 * | 1/2010 | Santiago | 114/294 |
| 2010/0024712 | A1 * | 2/2010 | Beaty | 114/364 |

* cited by examiner

*Primary Examiner* — Stephen Avila

(57) ABSTRACT

A shallow water anchor system provides a single arm arrangement with a fixed end of the arm mounted to the transom of a boat and the distal end of the arm retaining a rod adapted to be buried into the bottom of a lake, estuary, or other shallow body of water. The fixed end of the arm includes a first sheave and the distal end of the arm includes a second sheave, with a cable under tension between the first and second sheaves. A hydraulic operating mechanism drives a sliding block clamped to the cable. A hydraulic pressure is applied to one side of the other of a hydraulic piston with a cylinder to drive the operating mechanism, the sliding block moves back and forth thereby moving the arm up and down in a rotary motion about a shaft on the fixed end of the arm. In the down position, the rod is embedded into the bottom. In the stowed position, the arm is oriented straight up in a vertical position.

35 Claims, 9 Drawing Sheets

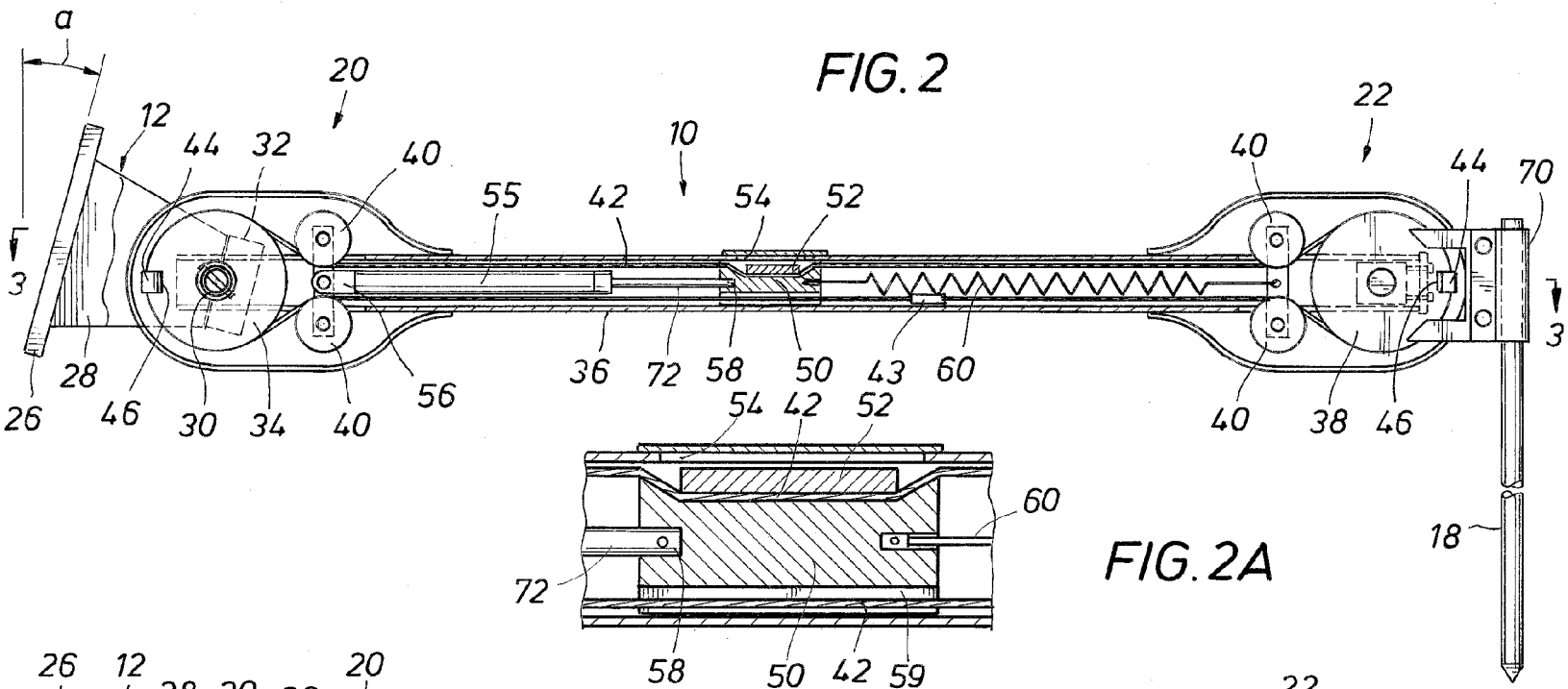
FIG. 2
FIG. 2A
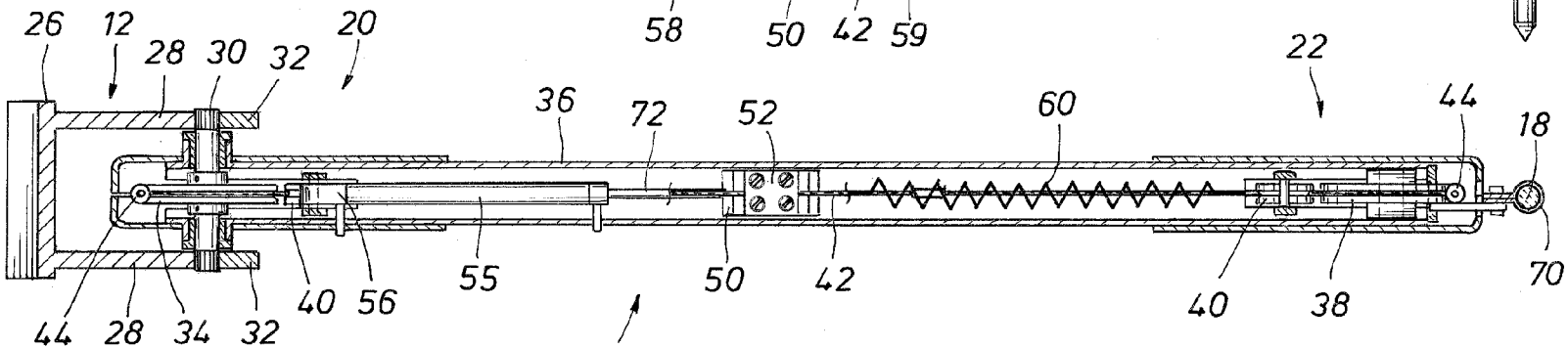
FIG. 3

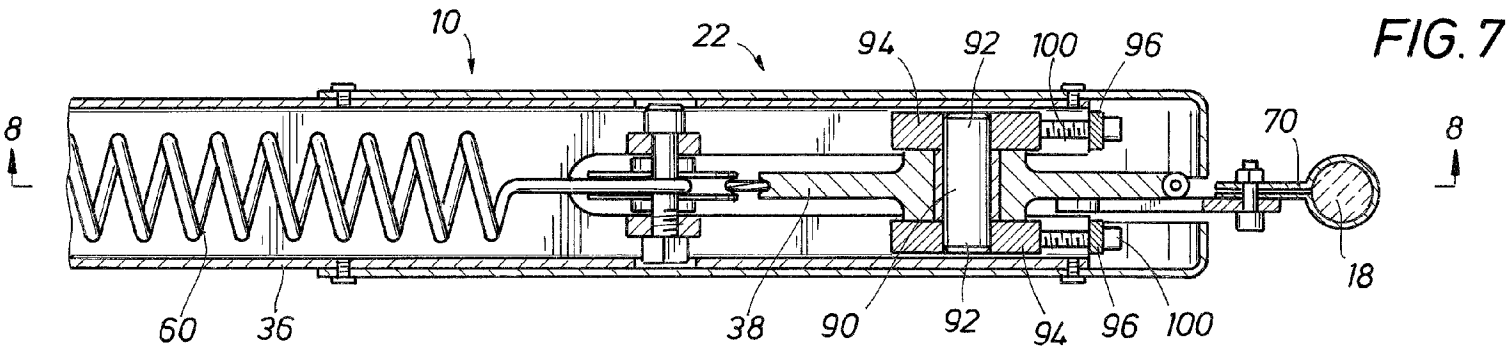
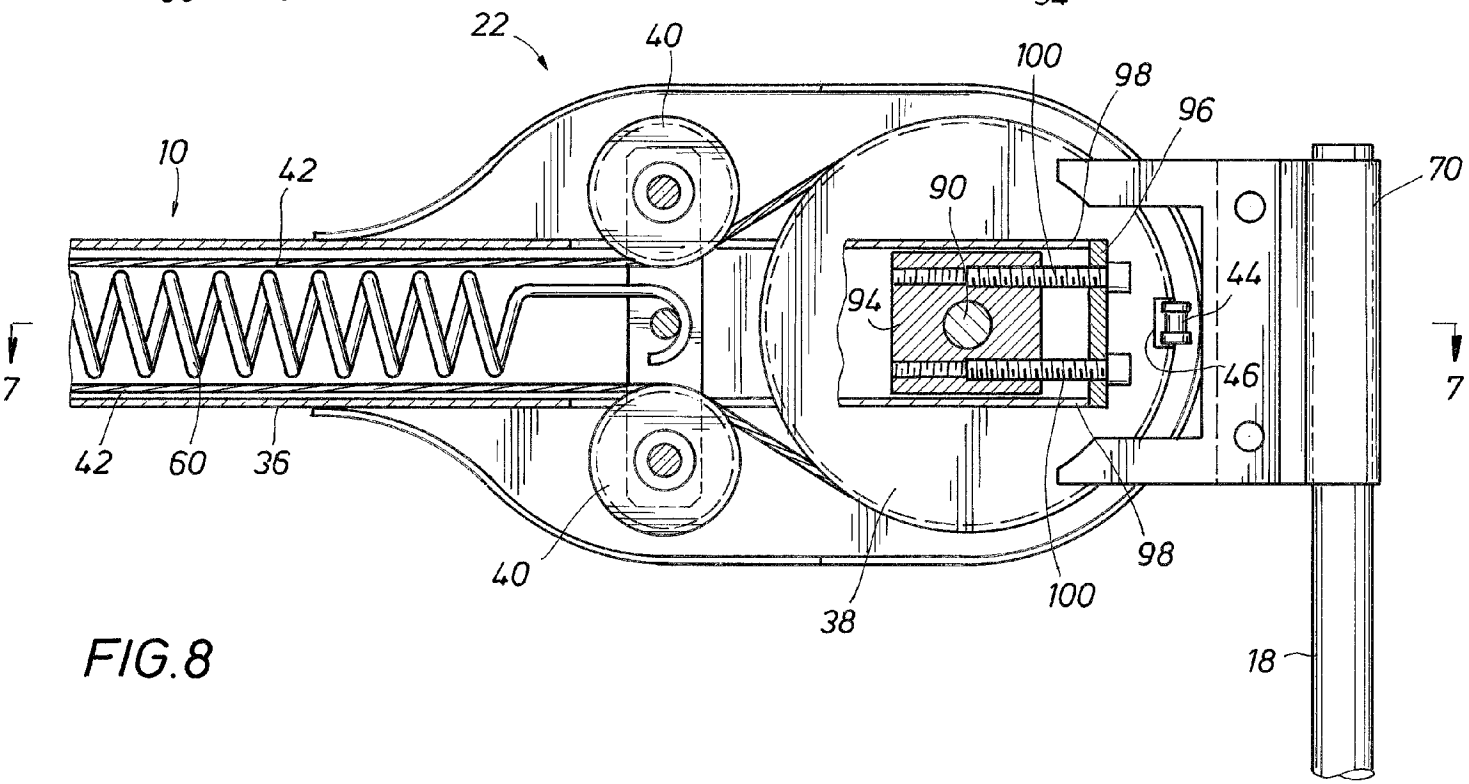
FIG. 8

D
118
128
126
122
124
132
134
120
130

SHALLOW WATER ANCHOR SYSTEM FOR FISHING BOATS

This application claims the benefit of U.S. Provisional Application Ser. No. 61/068,087 filed Mar. 5, 2008.

FIELD OF THE INVENTION

The present invention relates generally to the field of anchoring devices for marine vessels, and, in particular, to an articulated anchor system adapted to hold a small boat in a stationary position in shallow water.

BACKGROUND OF THE INVENTION

Along many coastal areas of the United States, and in certain lakes and estuaries, fishermen fish from small boats in shallow water. In these types of fishing areas, there are extensive shallow, sandy-bottomed or grassy-bottomed regions, generally referred to as flats, that are populated by various sport fish. Fishermen who fish these flats often use one or another of several methods of holding a boat at a selected location. These methods include the use of conventional anchors, the use of a pole shoved into the bottom and secured to the boat, or other methods.

As described by Oliverio et al. in U.S. Pat. No. 6,041,730, the use of anchors such as a Danforth or a similar type of anchor by flats fishermen has several shortcomings. First, such types of anchor do not firmly fix the position of the boat so that the boat can may drift at the end of the anchor line. Second, when setting and retrieving an anchor, the anchor's flukes may rip sea grass out of the bottom and cause ecological damage. Finally, when the anchor is hauled in, mud and sea grass from the anchor can foul the inside of the boat.

Other means of securing a boat in shallow water include a pole-like structure to which the both may be secured. In addition to Oliverio et al., other references dealing with similar means include U.S. Pat. No. 458,473 wherein MacDonald describes a jointed structure hinged to a submersible coastal artillery battery and comprising a pole inserted into the bottom of a shallow body of water. Other elongate pole-like anchoring mechanisms not hingedly secured to a vessel are taught by Mestas et al. in U.S. Pat. No. 4,960,064 and by Stokes in U.S. Pat. No. 4,702,047. Mechanisms other than anchors that are hingedly attached to a vessel hull are taught, inter alia, by Alexander, in U.S. Pat. No. 2,816,521 and by Sherrill in U.S. Pat. No. 3,046,928, both of whom show stem stabilizers, and by Doerffer, in U.S. Pat. No. 4,237,808, who shows a braking device.

The structure of Oliverio et al. requires an upper arm and a lower arm which together form a parallelogram, with one side of the parallelogram anchored to the transom of the boat, and the opposite side of the parallelogram retaining a rigidly fixed anchor pole. With this structure, the total range of movement of the mechanism is by necessity less than 180°. This can limit the depth at which the anchor may be effectively used. The structure shown and described in Oliverio et al. is rigidly dictated in the mounting of the parallelogram to the transom of the boat. In order to adapt the mounting of the structure to a boat with any slant other than that predetermined by the structure requires shims and adapter plates to arrange the anchor pole to the proper deployed position. The Oliverio et al. structure also has numerous pinch points that can damage equipment, injure people and become fouled with weeds or debris in the water.

Thus, there remains a need for a shallow water anchor that provide a range of movement of 180°, or even more, to maximize the effective depth of the anchor. The anchor should preferably be light-weight to make the anchor easier to use and make the most of the prime mover of the mechanism. The mounting structure of the apparatus should also easily adapt the mount to any reasonable slant of the transom relative to the surface of the water. The anchor device should also have a minimal number of pinch points exposed to users, equipment and matter in the water. The present invention is directed to filling these needs and others in the art.

BRIEF SUMMARY OF THE INVENTION

The shallow water anchor shown and described below solves these and other drawbacks of known anchor systems by providing a single arm arrangement with a fixed end of the arm adapted to be mounted to the transom of a boat and the distal end of the arm having a rod coupler for retaining a rod section adapted to be buried into the bottom of a lake, estuary, or other shallow body of water. The fixed end of the arm includes a first sheave and the distal end of the arm includes a second sheave, with a cable under tension between the first and second sheaves. A hydraulic operating mechanism drives a sliding block clamped to the cable. When a hydraulic pressure is applied to one side or the other of a hydraulic piston with a cylinder to drive the operating mechanism, the sliding block moves back and forth thereby moving the arm up and down in a rotary motion about a single shaft forming a single axis rotary mount on the fixed end of the arm. In the down position, the rod section end is adapted to be embedded into the bottom. In the stowed position, the arm is adapted to be oriented straight up in a vertical position.

By providing a single arm for retaining the rod, the entire mechanism can be made much lighter. This also means that the hydraulic means can be much more efficiently used. Further, by using the cable and sheave arrangement, a much shorter hydraulic cylinder stroke is required to move the arm, which results in a faster deployment of the rod (3 seconds vs. 6 seconds for known anchor systems). The single axis rotary mounting system for the fixed end of the arm provides for an adjustment, so that the system can be easily mounted to various angles of transom for boats without any shims or adapting brackets. The single axis rotary mounting system also allows a single arm to rotate 180° to maximize the anchoring depth. A shear pin is provided for the outer sheave to reduce the likelihood of damages to the rod if the boat should be underway with the rod deployed. A spring-loaded flexible subsystem for the arm may be used, to help keep the boat in place when the boat is subjected to wave action.

These and other features and advantages of this invention will be readily apparent to those skilled in the art.

BRIEF DESCRIPTION OF THE DRAWINGS

So that the manner in which the above recited features, advantages and objects of the present invention are attained and can be understood in detail, more particular description of the invention, briefly summarized above, may be had by reference to embodiments thereof which are illustrated in the appended drawings.

FIG. 2 is a sectional side view of the presently preferred embodiment of the anchor in a horizontal position.

FIG. 2A is a detail side view of a sliding block portion of FIG. 2.

FIG. 3 is a sectional top view as indicated by section lines 3-3 in FIG. 2

FIG. 7 is a sectional top view as indicated by section lines 7-7 in FIG. 8, showing the distal end of the main arm in more detail.

FIG. 8 is a sectional detail view as indicated by section lines 8-8 in FIG. 7.

DETAILED DESCRIPTION OF THE INVENTION

Figure 1:
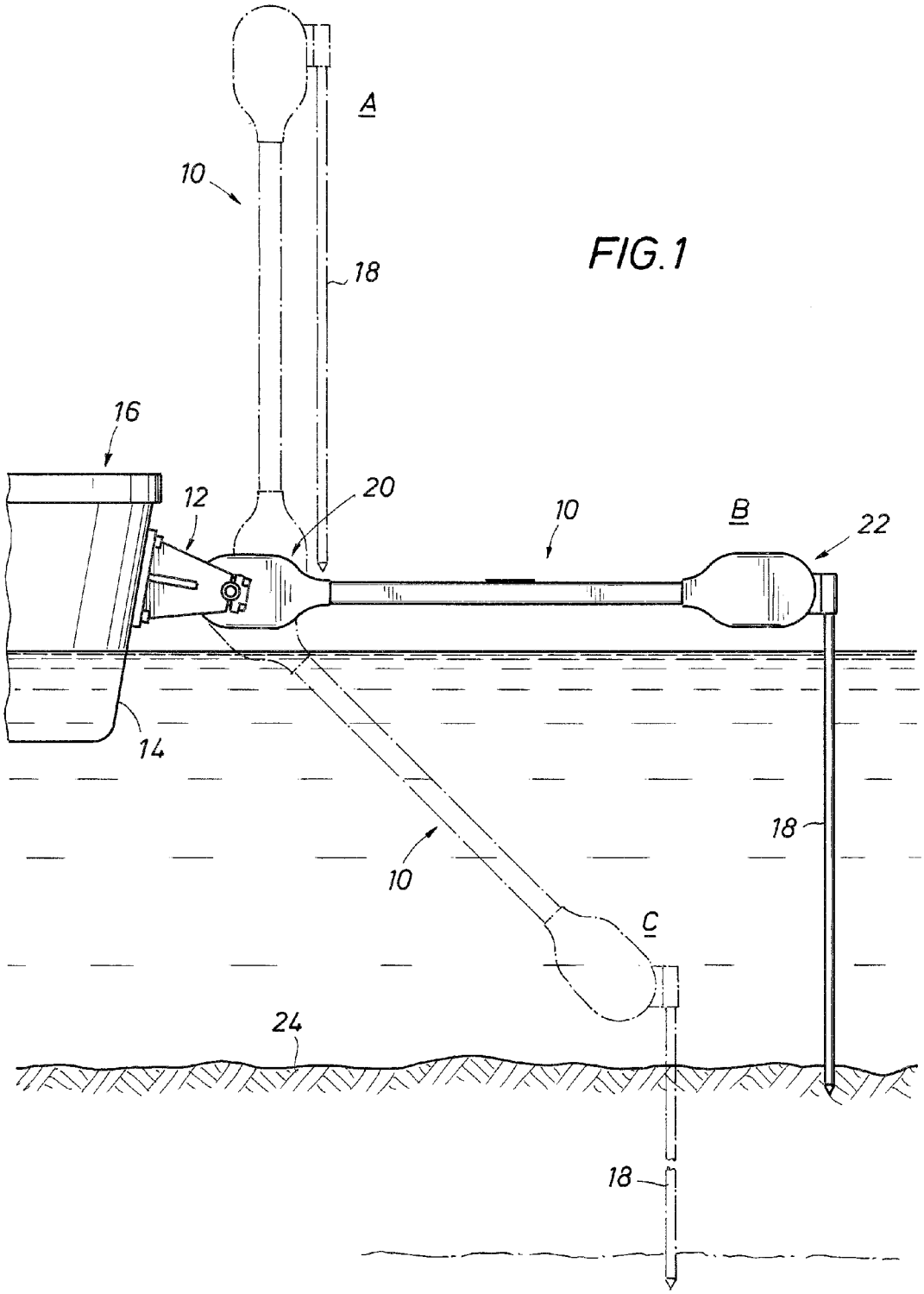
FIG. 1 is a side, elevation view showing the anchor in several positions.

FIG. 1 illustrates shallow anchor system constructed in accordance with the teachings of this invention. The system includes a main arm 10 which is rotatably attached by a fixed end 20 to a mounting bracket 12. The mounting bracket 12 in turn is fixedly attached to a transom 14 of a fishing boat 16. By a power mechanism, preferably a hydraulic means as described below, the arm 10 is rotated into various positions such as A, B, and C, for example. When the arm is in position A, the anchor system is in the stowed position, as it would be when not in use, such as for example while the boat is under powered motion. Position B of the arm is an intermediate position, for illustration purposes extending horizontally. When the arm 10 is in position C, the arm is partially lowered to a deployed orientation.

Opposite the fixed end 20 of the arm 10 is a distal end 22. A bottom engaging member such as a rod section 18 is rotatably connected to the distal end 22 of the arm 10 in a manner to maintain a vertical orientation for the rod section 18 in all positions of the arm 10, as described below in greater detail. The rod section 18 is driven into the bottom 24 of the lake or other body of water, thereby anchoring the boat 16 at a location dictated by the operator.

FIGS. 2 and 3 illustrate certain details of the preferred structure of the arm 10 and its mounting. Referring first to the fixed end 20 of the arm 10, the bracket 12 (see FIG. 1) includes a base plate 26, which is fixed to the transom 14 of the boat 16, such as for example by bolts or other fixing means. A pair of parallel forks 28 rigidly extend outwardly from the base plate a distance sufficient to receive a shaft 30. The shaft 30 is clamped to the forks 28 by retainers 32 so that the shaft 30 remains in a fixed relation to the bracket 12, i.e., the shaft 30 does not rotate relative to the forks 28. A first drive member, comprising a cable sheave 34 is mounted on the shaft 30 and also pinned to the shaft so that it cannot rotate. However, rotation of the arm 10 to the various positions shown in FIG. 1 is provided by the mounting of a tubular member 36 to the shaft 30 (see also FIGS. 5 and 6). This mounting provides a single axis rotary mount for securing a single arm 10 to the boat.

Referring now to the distal end 22 of the arm 10, a second drive member comprising a single axis rotary connection in the form of a cable sheave 38 is rotatably mounted to the tubular member 36. The second sheave 38 is of the same diameter as the sheave 34. A cable 42 is slung around the sheaves 34 and 38. Pairs of idling sheaves 40, one pair at the fixed end 20 and one pair at the distal end 22, direct the cable 42 into the inside of tubular member 36. Sleeves 44, one sleeve at each end of the arm 10, are swaged onto the cable 42. Each sleeve 44 is nestled inside a notch 46 of its respective sheave 34 or 38 to prevent the cable 42 from slipping relative to the sheave. Tension to the cable 42 is preferably applied by a mechanism as described below in reference to FIGS. 7 and 8.

A sliding block 50 is positioned inside the tubular member 36. The sliding block 50 is preferably attached to the cable 42 by means of a clamp 52 or other appropriate means. Note, however, that the sliding block 50 defines a through-passage 59 through which the cable return passes without obstruction. In this way, movement of the sliding block in one direction pulls the cable at the clamp 52 in that direction. As thus described, the block 50 comprises a link connection member that is affixed to the drive link provided by the cable 42. The tubular member 36 includes an opening 54 to provide access to the clamp 52 for assembly and repair of the device.

A linear drive mechanism, comprising a hydraulic cylinder mechanism 55 is mounted with its cylinder end 56 coupled to the tubular member 36. A piston rod 72 (see FIG. 4) extends from the mechanism 55 and terminates at a rod end 58 which is coupled to one side of the sliding block 50. A tension spring 60 is attached to the other side of sliding block 50 at one end of the spring 60 and to a fixed point of the tubular member 36 adjacent the distal end 22 of the arm. The spring functions as a potential energy storage system to urge angular rotation of the arm 10. The tension of the spring 60 is sufficient to hold the arm 10 in a horizontal position, shown as position B in FIG. 2.

To move the arm to the various positions shown in FIG. 1, the hydraulic cylinder mechanism 55 is actuated. In other words, when hydraulic pressure is applied to the piston of the cylinder 55, the rod 72 moves to the right, thereby forcing the sliding block 50 to the right as well, as viewed in FIG. 2. This motion of the sliding block pulls the cable around the sheaves 34 and 38 in a clockwise direction, thus causing the arm 10 to rotate counter-clockwise around sheave 34, assisted by the tension of the spring 60. Hydraulic pressure to the other side of the cylinder piston 55 causes the sliding block 50 to be forced to the left, thus causing arm 10 to rotate clockwise, or downward, moving the rod 18 toward engagement with the lake bottom 24. As thus described, the cable 42 acts as a drive link connecting the drive members 34 and 38 to form a rotary drive assembly that produces counterclockwise rotation of the arm when the cylinder mechanism 55 is extended and clockwise rotation of the arm when the cylinder mechanism 55 is contracted. The sliding block and connection to the cable provide a link connection member for transferring movement from the linear drive mechanism to the rotary drive assembly.

A bracket 70 in the rod section 18 is attached to the sheave 38 to hold the rod section in a fixed relation to the sheave 38. Since the sheaves 34 and 38 are connected by the cable 42, and the sheave 34 cannot rotate, the sheave 38 also will not rotate, as the arm 10 moves up or down by rotating around the shaft 30. Thus, since the sheave 38 does not rotate, the bracket 70 also does not rotate and the rod section 18 will always maintain its vertical orientation.

Figure 4:
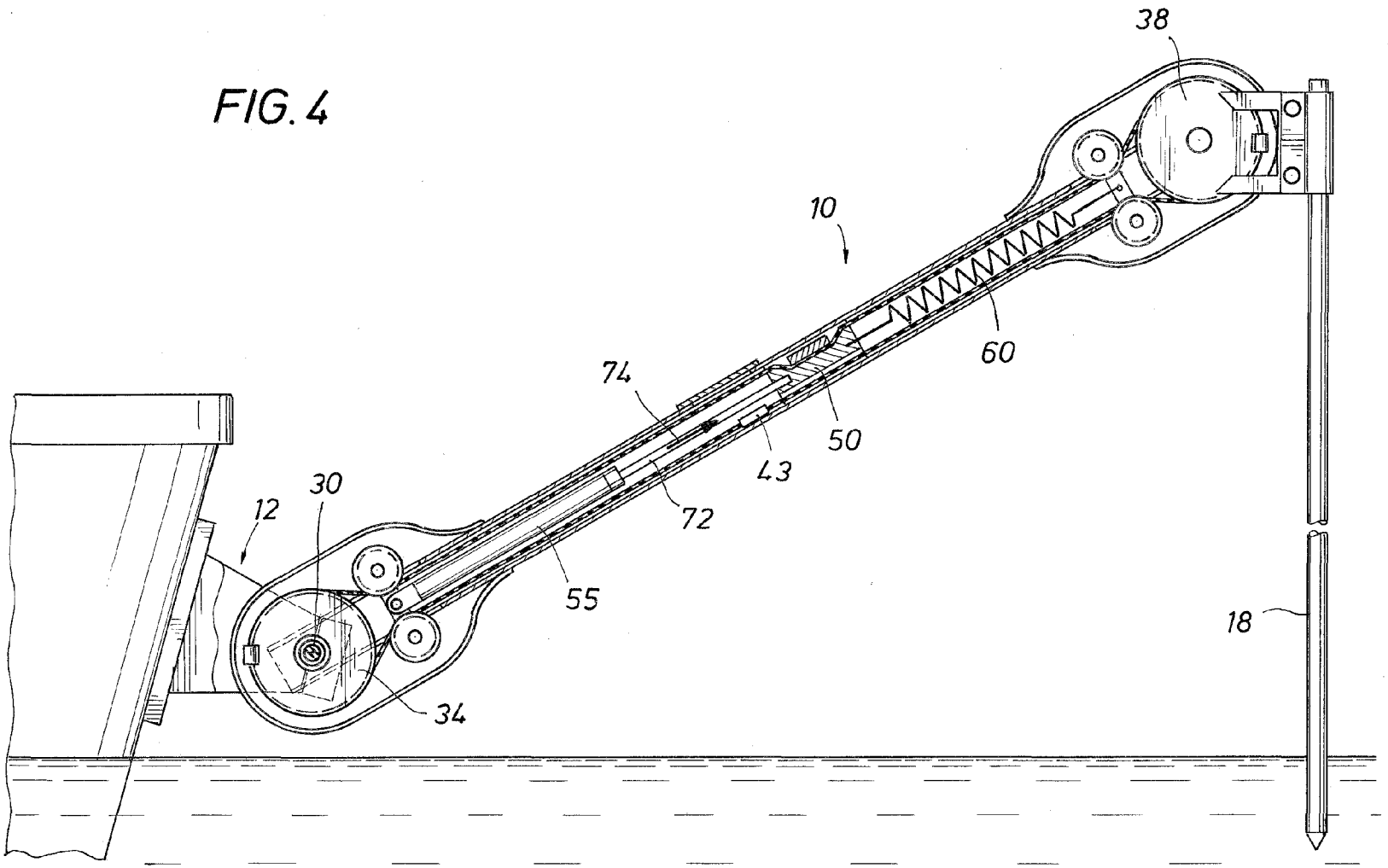
FIG. 4 is a sectional side view showing the device in a partially raised position.

FIG. 4 shows the anchor mechanism partially raised or rotated counter-clockwise around shaft 30. The cylinder rod 72 has been extended in a direction indicated by the number 74, pushing the sliding block 50 to the right, assisted by contracting the spring 60, thus lifting the arm 10 up and pulling the rod section 18 away from the lake bottom.

Figure 5:
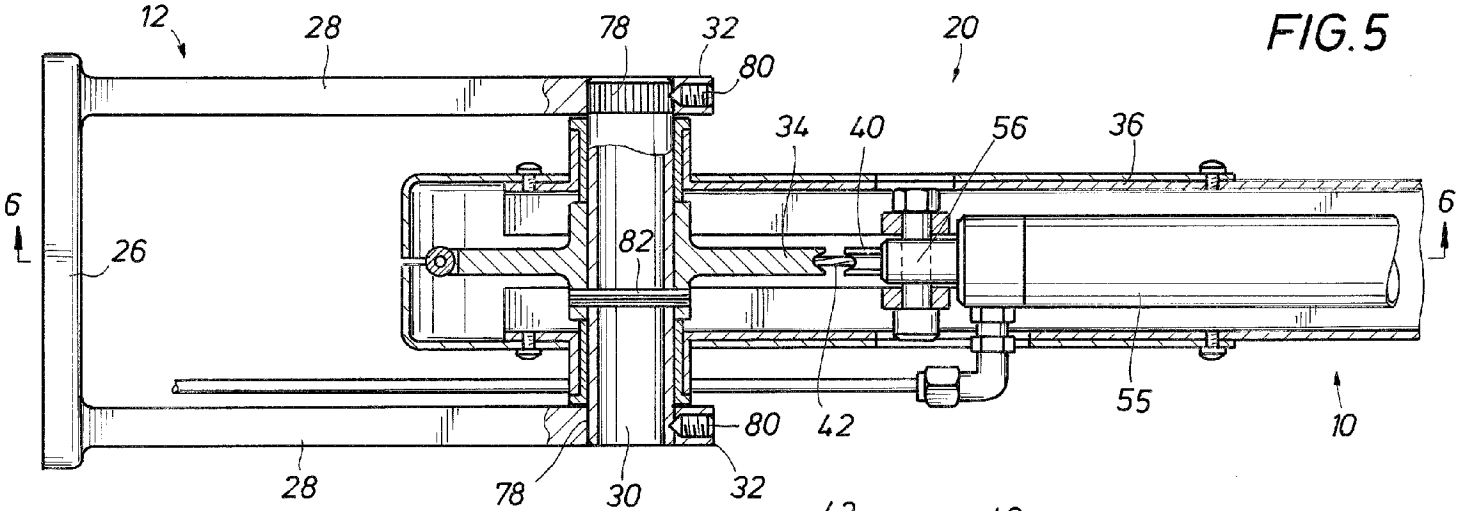
FIG. 5 is a sectional top detail view as indicated by section lines 5-5 in FIG. 6, showing the fixed end of the main arm in more detail.
Figure 6:
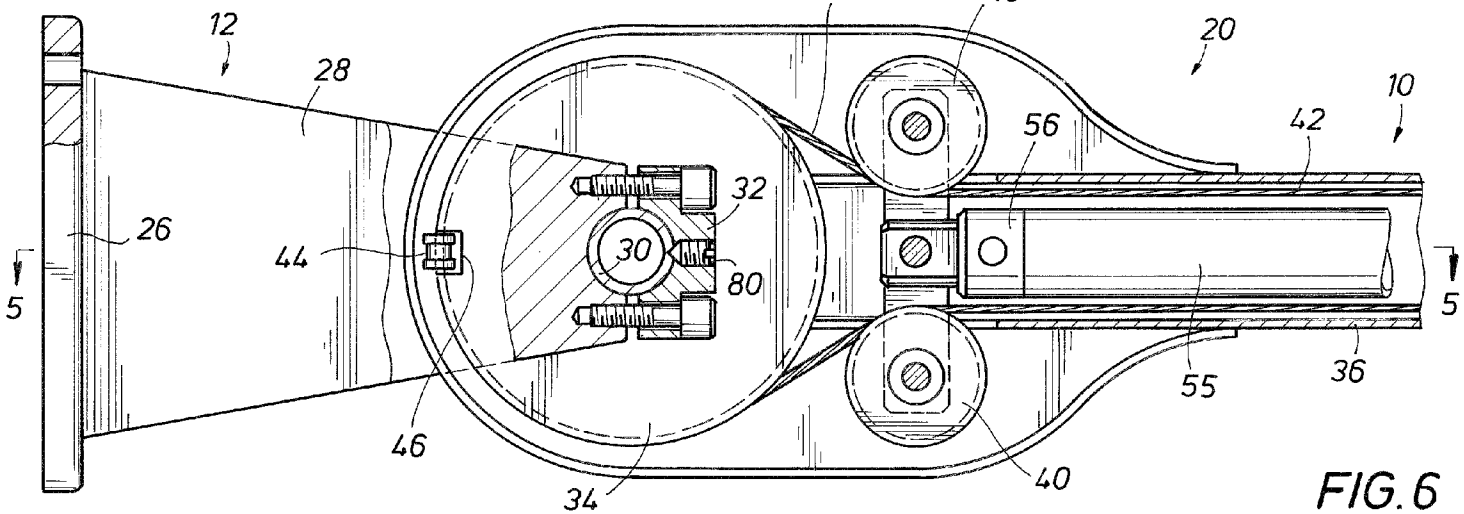
FIG. 6 is a sectional side detail view as indicated by section lines 6-6 in FIG. 5.

FIGS. 5 and 6 illustrate more details of the fixed end 20 of the arm 10. The shaft 30 defines knurled ends (78), where the shaft 30 is engaged by the clamps 32, to retain the shaft 30 in locking engagement with the forks 28 of the mounting bracket 12. The locking engagement of the shaft is assisted by a pair of set-screws 80. The sheave 34 is connected to the shaft 30 by a pin 82 so that the sheave 34 is prevented from rotating as arm 10 rotates up or down. This arrangement allows an angle α (see FIG. 2) to be adjusted according to the angle of the boat transom, against which the mounting plate must be mounted. The angle α is adjusted by loosening the clamps 32 (including the set screws 80), rotating the arm 10 into a perfectly vertical position A (as shown in FIG. 1) while the cylinder rod 72 is completely extended, and re-tightening the clamps 32 and set-screws 80.

FIGS. 7 and 8 show the distal end 22 of the arm 10 in more detail, specifically the tensioning means for the cable 42. The sheave 38 rotates relative to a shaft 90. Outer ends 92 of the shaft 90 extend into a pair of opposing plates 94, which are slidably held inside the tubular member (36). Bridge bars 96 rest against the open ends 98 of the tubular member 36 and provide a fixed base toward which the opposing plates 94 can be pulled by a set of bolts 100. The bolts screw into the opposing plates 94 and as the bolts are turned in a clockwise direction, the plates are moved to the right as seen in FIGS. 7 A*nd* 8, thus forcing the shaft 90 and therefore the sheave 38 to the right and increasing tension of the cable 42.

As previously described, a cable is preferably used as the connecting means between sheaves 34 and 38 for economic reasons; however a much more expensive arrangement consisting of chain and sprockets is also possible, expensive because of the environment in which this anchor will be used, all materials used must non-corroding, like aluminum, stainless steel, bronze and plastic. Thus, as used herein, the term "continuous loop of material" refers to a cable, a chain, or other means of engaging the sheaves 34 and 38. The cable 42 shown in FIG. 2 is continuous, even though it is preferably constructed of cable cut to length, and formed into a loop by a joining member 43.

The anchor system thus far described and as shown in FIG. 1 thru 8 works well in calm water. When there is wave action though, the lower end of the rod section 18 may be pulled out of the bottom 24 by waves lifting up boat 16 to which the anchor is attached. While this problem cannot be completely eliminated, such as when the boat is in a storm, the problem can be alleviated by the embodiment illustrated in FIGS. 9 to 12. This embodiment provides a flexible connection between piston rod 72 and the cable 42. As will be described, the flexible connection acts as a potential energy system for urging rotation of the arm 10. The piston rod 72 is extended beyond and through the sliding block 50 and the rod is provided with collars 106 and 108. A compression spring 110 is placed between the collar 108 and sliding block 50.

Figure 9:
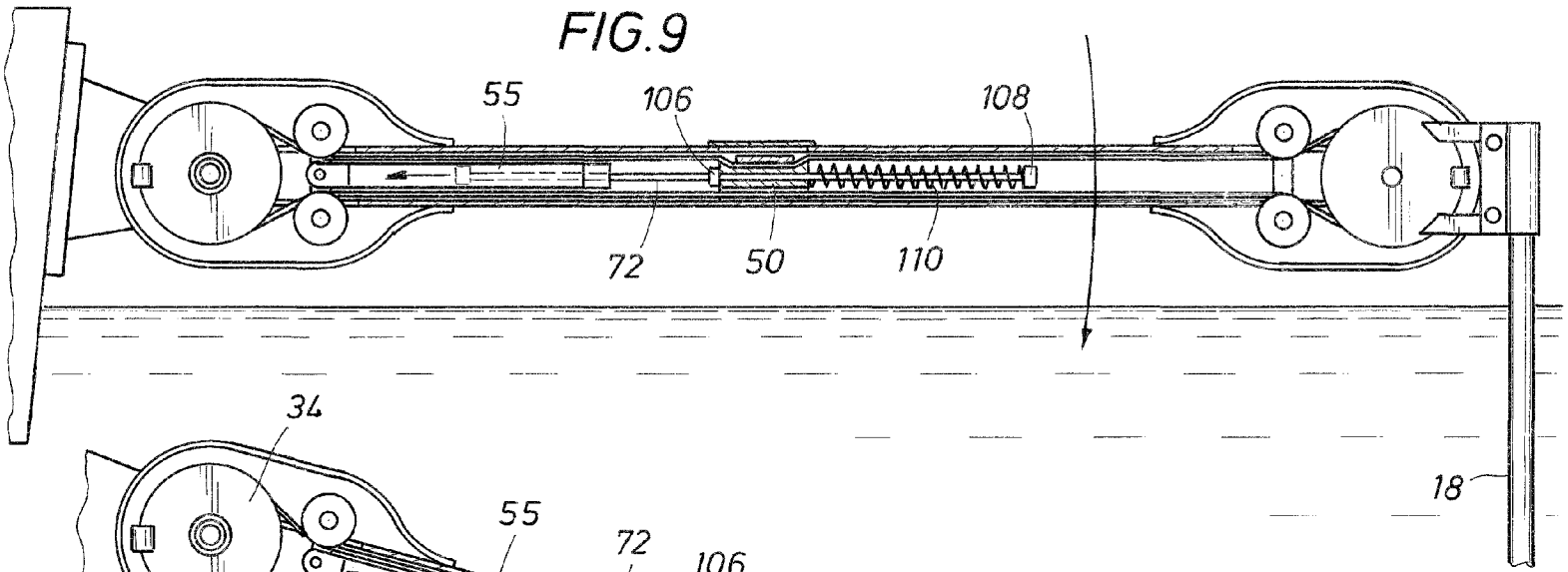
FIG. 9 is side view of another presently preferred embodiment of the device in a partially deployed position.
Figure 10:
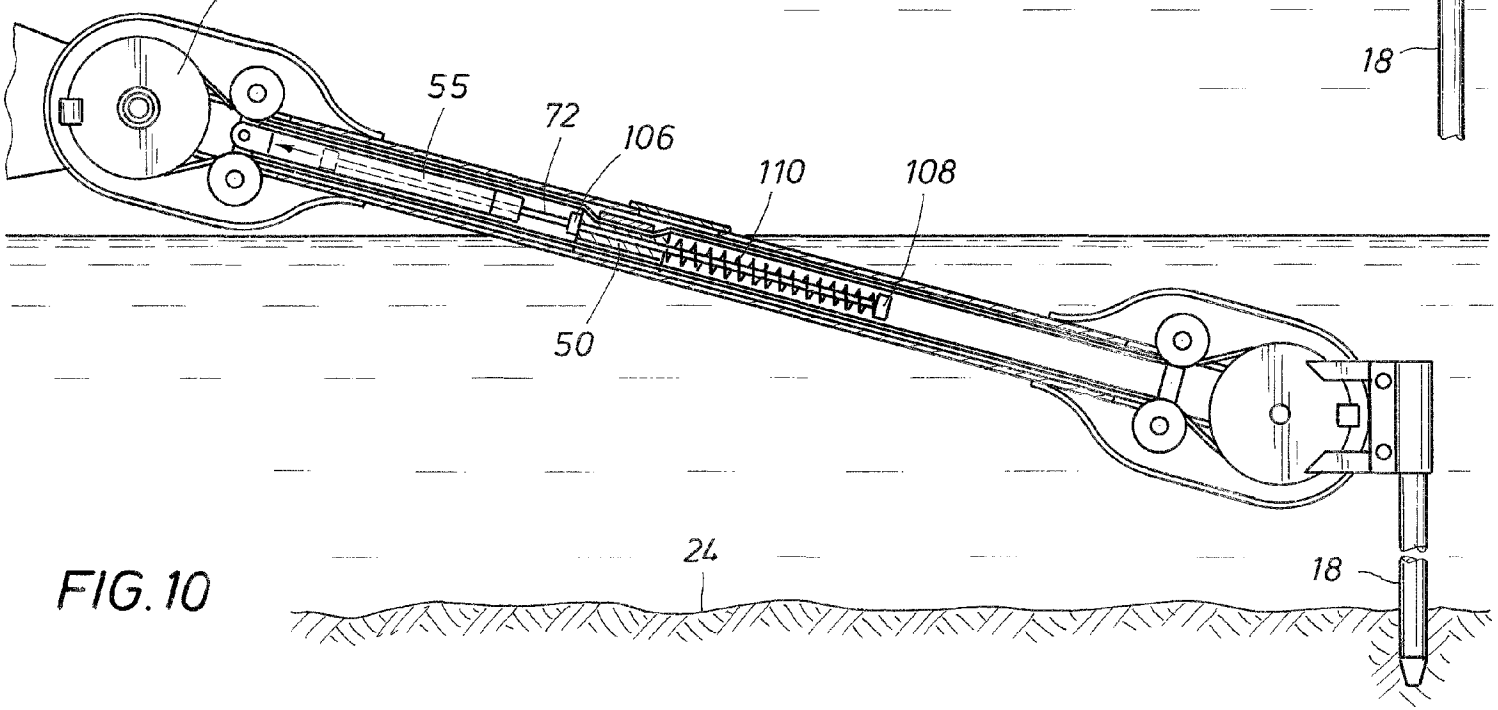
FIG. 10 is a side view of the embodiment of FIG. 9 in a deployed position.
Figure 11:
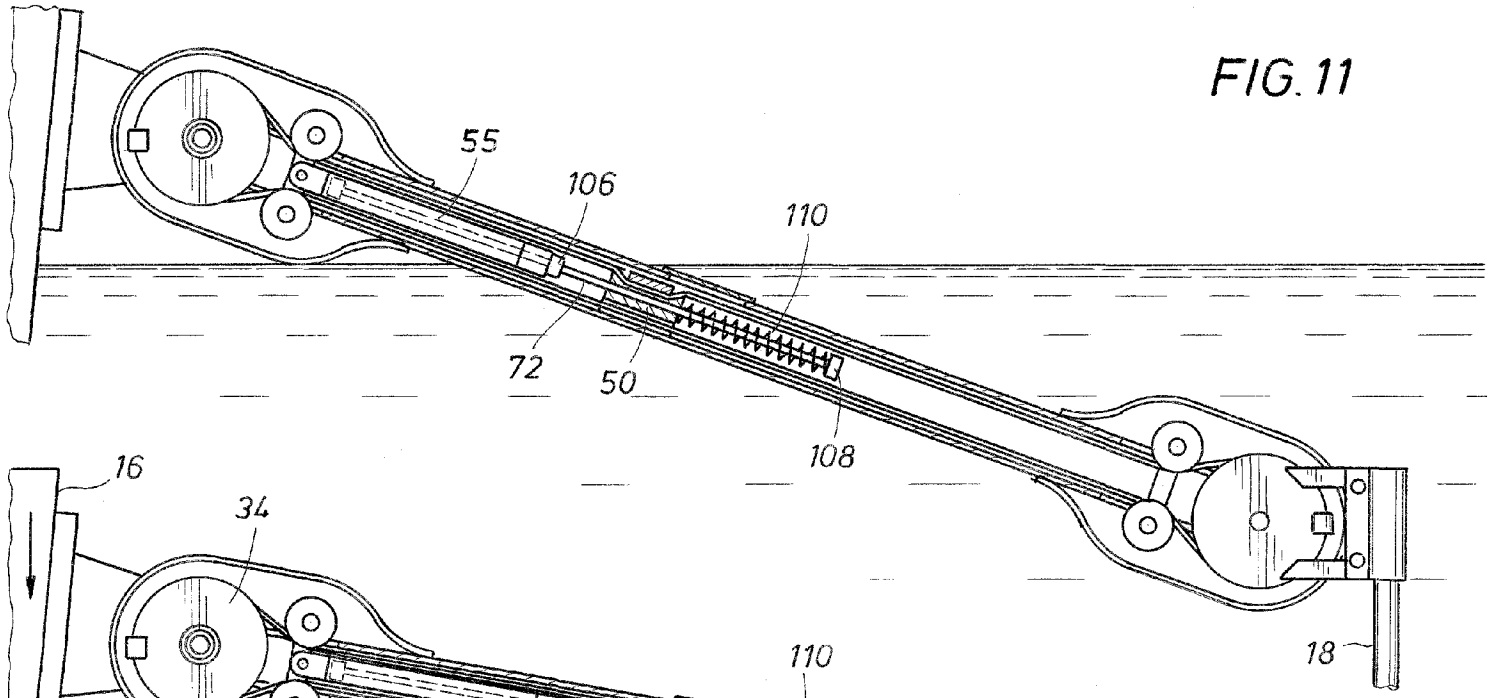
FIG. 11 is a side section view showing details of the function of the embodiment of FIG. 9.

In FIG. 9, the rod 72 from the cylinder 55 is 50% extended so the tubular member 36 is in a horizontal position. In this position, the compression spring 110 is partially compressed. To lower the anchor to a position as shown in FIG. 10 where the rod 18 is embedded into the bottom 24, the piston rod 72 is further retracted into the cylinder 55, the sliding block 50 is moved and has pulled on the cable 42 to rotate the arm 10 clockwise around sheave 34. Continued supply of hydraulic fluid to the cylinder 55 forces the rod 72 to retract further until the collar 106 reaches its end position against the cylinder 55, as illustrated in FIG. 11. While the sliding block 50 is unable to move, and thus sheave 34 is also held in place, the arm 10 rotates clockwise and maintains contact with bottom 24 through the compression spring 110 being compressed between the collar 108 and the block 50.

Figure 12:
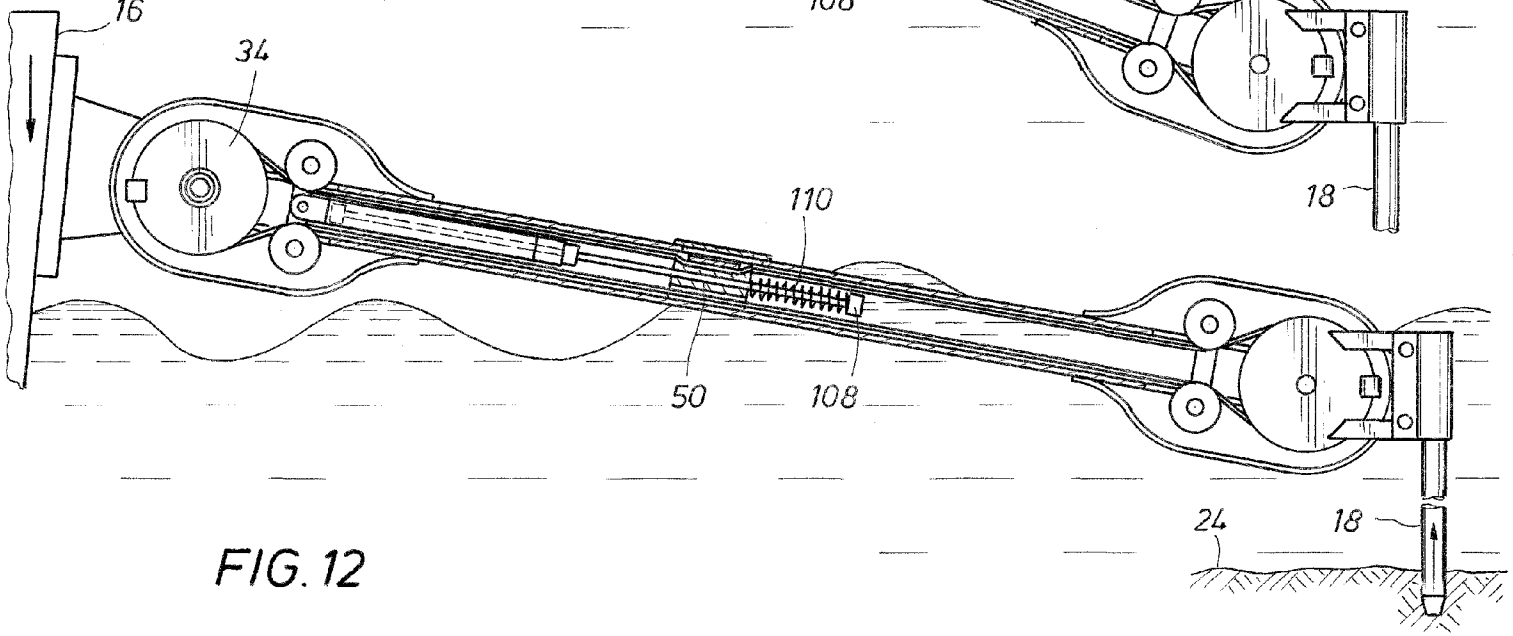
FIG. 12 is a side section view showing details of the function of the embodiment of FIG. 9 in choppy water.

FIG. 12 illustrates conditions where wave action lowers boat 16 but the rod section 18 is stuck in the ground so it cannot go any lower. Under those conditions, the anchor 10 must rotate counter-clockwise around the sheave 34, which reduces the distance between the block 50 and the collar 108, compressing the spring 110 even more. When wave action causes the boat 16 to rise, the stored energy in the spring 110 pushes the block 50 toward the distal end of the arm. As thus illustrated and described, the compressed spring is understood to exert the stored energy of the spring causing clockwise rotation of the arm to maintain contact of the rod section with the water bottom as the boat rises.

Figure 13:
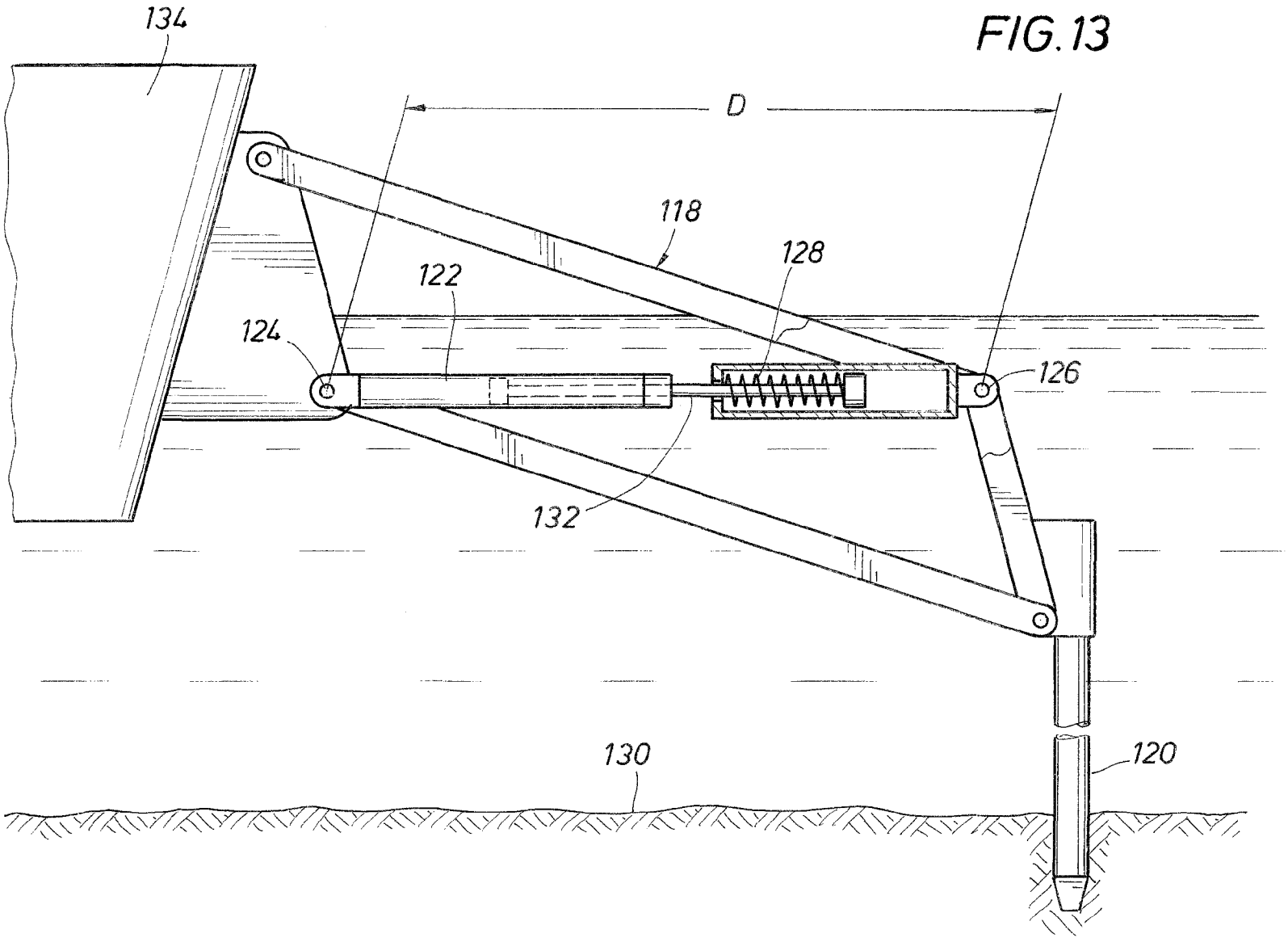
FIG. 13 is side section view of a parallelogram embodiment, modified with the improvement of FIG. 9.

This feature of the present invention may also be applied to known structures, as shown in FIG. 13. FIG. 13 illustrates an anchor using a parallelogram 118 of links to maintain a vertical position of a ground-engaging rod 120. The motion of the rod 120 is caused by a cylinder 122, which changes the distance D between opposing pivot points 124 and 126. When the rod 120 has engaged the bottom 130 and the parallelogram 118 has reached a fixed configuration, energy can be stored in a spring 128 by further retracting a piston rod 132 and compressing the spring 128. This energy can be used to reduce the distance D, thus pushing the rod 120 down when wave action lifts boat 134 up.

Figure 14:
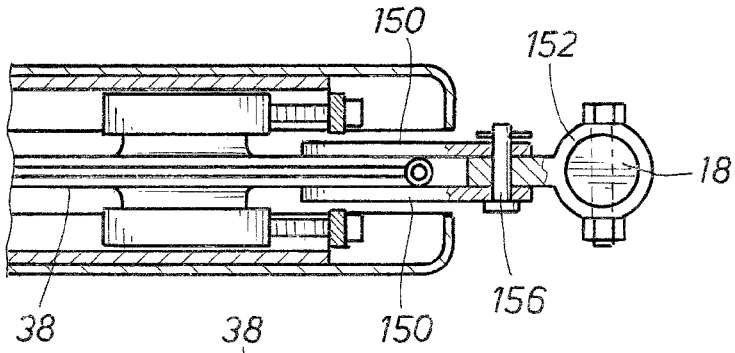
FIG. 14 is a top section detail view of a presently preferred distal end of the device.
Figure 15:
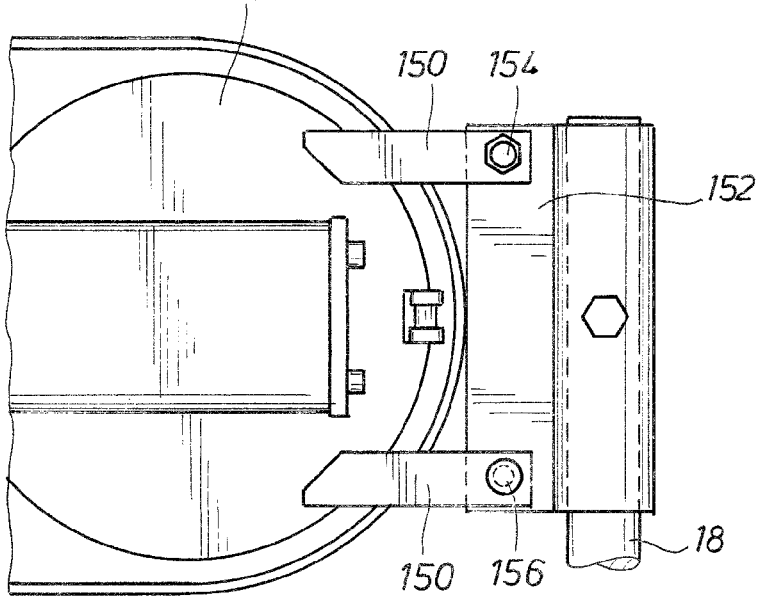
FIG. 15 is a side detail view of the embodiment of FIG. 14.

A common mishap occurs when anglers leave an anchor deployed with a rod embedded into the bottom 24 and set their boat into motion. With enough force, the rod stuck in the bottom may break, or the bracket mounting the rod may be damaged. The embodiment of FIGS. 14-16 solves this problem by changing the way the rod section 18 is mounted to the sheave 38.

Figure 16:
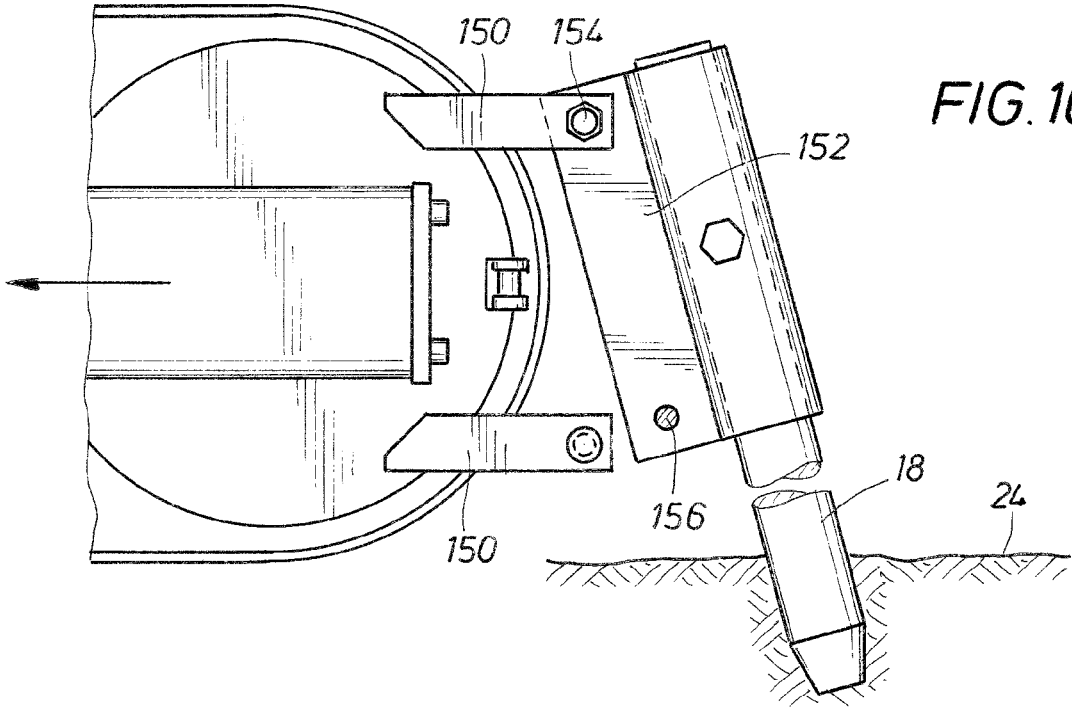
FIG. 16 is a side detail view of the embodiment of FIG. 14 in a different position.

In this embodiment, extensions 150 are attached to the sheave 38, holding a bracket 152 in between by a bolt 154 and a shear pin 156. As the boat and anchor start moving and the rod section 18 is still embedded in the ground (as shown in FIG. 16), the shear pin 156 shears off to allow the bracket 152 to rotate around the bolt 154. This motion alters the angle at which the rod is set in the bottom until the rod pulls free from the bottom, thus saving the rod section 18 from breaking.

The principles, preferred embodiment, and mode of operation of the present invention have been described in the foregoing specification. This invention is not to be construed as limited to the particular forms disclosed, since these are regarded as illustrative rather than restrictive. Moreover, variations and changes may be made by those skilled in the art without departing from the spirit of the invention.

I claim:

1. A shallow water anchor system for a boat, the anchor comprising:

a single arm defining a fixed end and a distal end, the arm having a single axis rotary mount at the fixed end;

a bottom engaging member coupled to the distal end of the arm;

means for maintaining the bottom engaging member in a fixed orientation at any rotary position of the arm;

a first drive member adjacent the fixed end;

a second drive member adjacent the distal end; and a drive link connecting the first and second drive members for effecting the fixed orientation of the bottom engaging member as the arm is rotated about the single axis rotary mount.

2. A shallow water anchor system as defined in claim 1 wherein the drive link is at least partially carried within the arm.

3. A shallow water anchor as defined in claim 2 wherein at least a portion of the arm comprises a housing and the drive link is at least partially enclosed within the housing.

4. A shallow water anchor system as defined in claim 1 further comprising a powered link connection member affixed to the drive link at a first location of the drive link.

5. A shallow water anchor system as defined in claim 4, further comprising a spring joining the powered link connection member and the second drive member.

6. A shallow water anchor system as defined in claim 1, wherein the single axis rotary mount includes a first shaft adapted to be non-rotatably secured to a boat whereby the arm may be rotated about the first shaft when the first shaft is secured to a boat.

7. A shallow water anchor system as defined in claim 1 further comprising a distal-end mounting bracket for mounting the bottom engaging member to the second drive member.

8. A shallow water anchor system as defined in claim 7 further comprising a second shaft included in the distal-end mounting bracket for securing the bottom engaging member to the arm for rotational movement relative to the arm and wherein the first and second shafts are carried in the arm at a fixed distance from each other in all rotational orientations of the arm relative to the first shaft.

9. A shallow water anchor system as defined in claim 7 further comprising an automatic release mechanism for permitting rotational movement of the arm relative to the bottom engaging member when the anchor system is exposed to rotational forces between the arm and the bottom engaging member exceeding a defined limit.

10. A shallow water anchor system as defined in claim 9 wherein the automatic release mechanism comprises a shear pin securing the distal end mounting bracket and the bottom engaging member.

11. A shallow water anchor system as defined in claim 1 further comprising a prime mover responsive to a power source to move the arm between a first angular position and a second angular position, the prime mover being at least partially carried within the arm.

12. The anchor system of claim 11 further comprising a first holding means holding the drive link to the first drive member and a second holding means holding the drive link to the second drive member.

13. A shallow water anchor system as defined in claim 12 further comprising a hydraulic actuator for moving the drive link.

14. A shallow water anchor system as defined in claim 13 wherein the hydraulic actuator includes a piston rod coupled to the drive link.

15. A shallow water anchor system as defined in claim 14 further comprising a flexible connection between the piston rod and the link connection member comprising a spring.

16. A shallow water anchor system as defined in claim 1 further including an energy storage system for storing energy when the arm is urged downwardly toward a water bottom below the boat.

17. A shallow waters anchor system as defined in claim 16 wherein the energy storage system includes means for biasing the arm toward the water bottom when the boat moves away from the water bottom.

18. A system as defined in claim 17 wherein the energy storage system includes a spring that is energized when the anchor is urged toward a water bottom.

19. A system as defined in claim 18 wherein the energy storage system includes a compression spring.

20. An anchor system as defined in claim 1 wherein the arm includes a structural support assembly providing a primary support structure between the fixed end and the distal end of the arm.

21. An anchor system as defined in claim 20 wherein the bottom engaging member includes a water bottom engaging rod.

22. An anchor system as defined in claim 21 wherein the structural support assembly comprises a tubular body extending between the fixed end and the distal end of the arm to form a housing.

23. A shallow water anchor system for a boat, the anchor comprising:

a single arm defining a fixed end and a distal end, the arm having a single axis rotary mount at the fixed end;

a rod coupled to the distal end of the arm;

means for maintaining the rod in a fixed orientation at any rotary position of the arm;

a tubular member between and joining the fixed end and the distal end of the arm;

a first drive member in the fixed end;

a second drive member in the distal end; and a drive link connecting the first and second drive members and at least partially within the tubular member.

24. An anchor system as defined in claim 23 further comprising a link connection member affixed to the drive link and further comprising a spring joining the link connection member and the second drive member.

25. An anchor system as defined in claim 23, further comprising a first shaft included in the single axis rotary mount for mounting the arm for rotatable movement at the fixed end of the arm and further comprising a clamp means for holding the first shaft to a boat to maintain a non-rotatable relationship between the first shaft and the boat.

26. An anchor system as defined in claim 23 further comprising a distal-end mounting bracket mounting the rod to the second drive member and a shear pin between the distal-end mounting bracket and the second drive member.

27. An anchor system as defined in claim 24 further comprising a prime mover responsive to a power source to move the arm between a first angular position and a second angular position, the prime mover being at least partially housed within the tubular member.

28. An anchor system as defined in claim 27, wherein the prime mover comprises a hydraulic actuator for moving the link connection member relative to the first drive member.

29. An anchor system as defined in claim 23 further comprising a first holding means holding the drive link to the first drive member and a second holding means holding the drive link to the second drive member.

30. An anchor system as defined in claim 28, wherein the hydraulic actuator includes a piston rod coupled to the link connection member.

31. An anchor system as defined in claim 23, further including an energy storage system for storing energy when the arm is rotated downwardly toward a water bottom below the boat.

32. An anchor system as defined in claim 31 wherein the energy storage system includes means for biasing the arm toward the water bottom when the boat moves away from the water bottom.

33. An anchor system as defined in claim 32 wherein the energy storage system includes a spring that is energized when the anchor is moved toward a water bottom.

34. An anchor system as defined in claim 33 wherein the energy storage system includes a compression spring.

35. A shallow water anchor system for a fishing boat, the anchor comprising:

an upper arm having a proximal end and a distal end, the proximal end of the upper arm hingedly attached to a hull of the boat whereby the upper arm is adapted to move between a raised position and a lowered position;

a lower arm having a proximal end and a distal end, the proximal end of the lower arm hingedly attached to the hull of the boat at a point lower on the boat then the upper arm;

a cross beam hingedly attached between the distal end of the upper arm and the distal end of the lower arm;

an actuator adapted to move the upper arm between the raised position and the lowered position, the actuator hingedly attached to the hull of the boat at the proximal end of the lower arm and further hingedly attached to the distal end of the upper arm;

a rod affixed to the distal end of the lower arm, wherein the rod is adapted to engage the bottom when the upper arm is in the lowered position; and the actuator comprises a hydraulic piston assembly affixed to the hull of the boat at the proximal end of the lower arm, the piston assembly including a rod extending therefrom and terminating in a guide piston.

* * * * *